United States Patent [19]

Bobrovnikov et al.

[11] 4,100,708

[45] Jul. 18, 1978

[54] BUILDING ROOFING STRUCTURE

[76] Inventors: Anatoly Pavlovich Bobrovnikov, ulitsa Usacheva, 25, kv. 91; Gennady Grigorievich Mikhailov, ulitsa Bolotnikovskaya, 24, korpus 7, kv. 65; Gennady Ivanovich Soloviev, ulitsa Davydkovskaya, 6, kv. 102; Sergei Grigorievich Chatchenko, ulitsa Govorova, 16, korpus 4, kv. 24, all of Moscow, U.S.S.R.

[21] Appl. No.: 757,973

[22] Filed: Jan. 10, 1977

[51] Int. Cl.[2] ..... E04C 3/10

[52] U.S. Cl. ..... 52/222; 52/223 R; 52/644; 52/650; 52/691; 52/693

[58] Field of Search ..... 52/690, 644, 83, 624, 52/222, 225, 223 R, 226, 650, 691, 693, 655

[56] References Cited

U.S. PATENT DOCUMENTS

| | | | |
|---|---|---|---|
| 793,358 | 6/1905 | Doyle | 52/225 X |
| 2,183,451 | 12/1939 | Forster | 52/226 X |
| 2,704,522 | 3/1955 | Frieder et al. | 52/644 X |
| 2,809,074 | 10/1957 | McDonald | 52/225 X |
| 2,939,554 | 6/1960 | Bolton et al. | 52/624 X |
| 3,091,313 | 5/1963 | Colbath | 52/691 X |
| 3,398,498 | 8/1968 | Krauss | 52/226 X |
| 3,461,636 | 8/1969 | Hern | 52/690 |
| 3,643,391 | 2/1972 | Mollinger | 52/222 X |
| 3,978,635 | 9/1976 | Theault | 52/693 |

*Primary Examiner*—Leslie Braun

*Attorney, Agent, or Firm*—Robert E. Burns; Emmanuel J. Lobato; Bruce L. Adams

[57] ABSTRACT

A characteristic feature of the present invention lies in that in the building roofing structure is made of a number of similar elements in the form of an arch and a tie beam. The tie beam of each arch is made of at least one panel with a framework comprising longitudinal chords and cross-pieces and of a prestressed sheet covering connected to the framework.

4 Claims, 8 Drawing Figures

BUILDING ROOFING STRUCTURE

BACKGROUND OF THE INVENTION

The present invention relates to the field of construction and more particularly it relates to building roofing structures.

The present invention can be used to advantage in construction of various buildings, for example exhibition halls.

Selection of the roofing structure plays an important role in the construction of various buildings.

Arch coverings are often used as basic structures for covering large spans. For example, a hangar in Bristol-Filton airport has a roof wherein the basic load-bearing elements are arches with tie beams. The tie beams interconnect the ends of the arches and, in addition, are fastened to them by hangars along the span between the supports. Girders are placed on the arches to support the roofing made of steel profiled decking.

A disadvantage of this structure lies in that the material of the roofing, i.e. the profiled steel decking takes no part in the load-bearing function of the arch and serves for protective purposes only. Moreover, when the roofing is leveled with the arches, both the roofing surface and the internal spaces of the building are larger than they are in the case of a flat roof which results in higher expenditures for heating the building.

Also known in the previous art is the roofing structure of standard hangars that were contructed in Germany in 1938 – 1941 . This structure consisted of a three-dimensional arch of a triangular section whose side faces were formed by a number of trapezoidal steel elements which acted as protection and simultaneously took part in the load-bearing function of the arch.

A disadvantage of this structure lies in that the roofing is located level with the arch which, like in the preceding example, increases the expenses for maintenance of the building.

Still another known structure of a hangar built in 1939 in Milan comprises an arch as the basic load-bearing element of the roofing. The ends of the arch are interconnected by a tie in the form of a rigid truss. Furthermore, the tie and the arch are interconnected along the span by double hangars. For arranging the roofing in the plane of the ties, there are provided trusses set perpendicularly to the ties and functioning as secondary beams. On these trusses are laid girders which support a slate roofing.

The disadvantages of this structure reside in a heavy weight and considerable difficulties in its erection since the roofing consists of a great number of elements; moreover, the roofing serves for protection only, and takes no part in the load-bearing function of the ties.

SUMMARY OF THE INVENTION

The main object of the invention resides in improving the roofing structure by reducing the number of its component elements and by making the roofing material participate in the load-bearing function of the tie.

Another object of the invention resides in improving the function of the roofing under antisymmetrical and alternate loads.

Still another object of the invention resides in increasing the stiffness of the tie in bending.

These and other objects are accomplished by providing a roofing structure in the form of a number of similar elements each consisting of an arch and a tie beam (or tie) whose ends are interconnected directly whereas along the span they are interconnected by double hangars wherein, according to the invention, the tie beam of each arch is made in the form of at least one panel consisting of a framework of longitudinal chords and cross-pieces and of a prestressed sheet covering secured to said framework.

It is practicable that the tie beam of each arch should be made of upper and lower panels arranged parallel to each other at different levels, the upper panel overlapping partly the lower one so that one of the longitudinal chords in the framework of the upper panel is set above the longitudinal chord in the framework of the lower panel and is connected thereto.

In another possible version the sheet covering of the lower panel is located between the longitudinal chords and cross-pieces of the framework.

The essence of the present invention is in the following.

The roofing is made up of a number of similar elements each consisting of an arch and a tie beam. At the ends the arch and the tie are interconnected directly while along the span they are connected by double hangars. The tie of each arch is made up of at least one panel which has a framework of longitudinal chords and cross-pieces and a prestressed sheet covering secured to said framework. When a downward load is applied to the roofing, the arch is subjected to compressive forces while the tie and hangars are acted upon by tensile forces. The forces arising in the tie are taken by the longitudinal chords of the panel framework jointly with the sheet covering. Inclusion of the sheet covering into the load-bearing function of the tie jointly with the longitudinal chords of the panel framework becomes possible because the covering is connected to the panel framework.

The connection of the covering with the panel framework ensures their joint work in tension as of a single integral element. Thus, the sheet covering acts as a roofing and simultaneously takes part in the load-bearing function of the tie.

When the roofing is subjected to an upward-directed load, this produces tensile forces in the arch and compressive forces in the tie and hangars. The sheet covering is prestressed for enabling it to take part in the load-bearing function of the tie under compressive loads.

The function of the roofing under antisymmetrical and alternate loads is improved also by prestressing the sheet covering.

Stiffness of the tie is increased by making the tie of each arch from an upper panel and a lower panel arranged parallel to each other at different levels, each panel consisting of a framework made up of longitudinal chords and cross-pieces, and a sheet covering connected to said framework. The upper panel overlaps partly the lower one so that one of the longitudinal chords of the upper panel framework is located above the longitudinal chord of the lower panel framework and is connected thereto. The sheet coverings of the upper and lower panels in this case may also be prestressed. In the version of the structure described herein the sheet covering of the lower panel can be located either on top of the panel framework or between the longitudinal chords and cross-pieces. In the latter case the cross-pieces and longitudinal chords are arranged at different levels.

The present invention can also be effectively used in buildings with skylights used for illumination and ventilation. If the skylights have vertical glasses, the longitudinal chords of the upper and lower panel frameworks arranged one above the other are interconnected by the uprights of the skylight frames. If skylights with inclined glass panes are required, the upper and lower panels are arranged in such a manner that the surface of the skylight frame connecting the longitudinal chords of the upper and lower panel frameworks forms the required angle to the horizon.

BRIEF DESCRIPTION OF THE DRAWING

Other objects and advantages of the invention will become apparent from the detailed description of the examples of the structure and from the accompanying drawings in which.

DESRIPTION OF THE PREFERRED EMBODIMENTS

Figure 1:
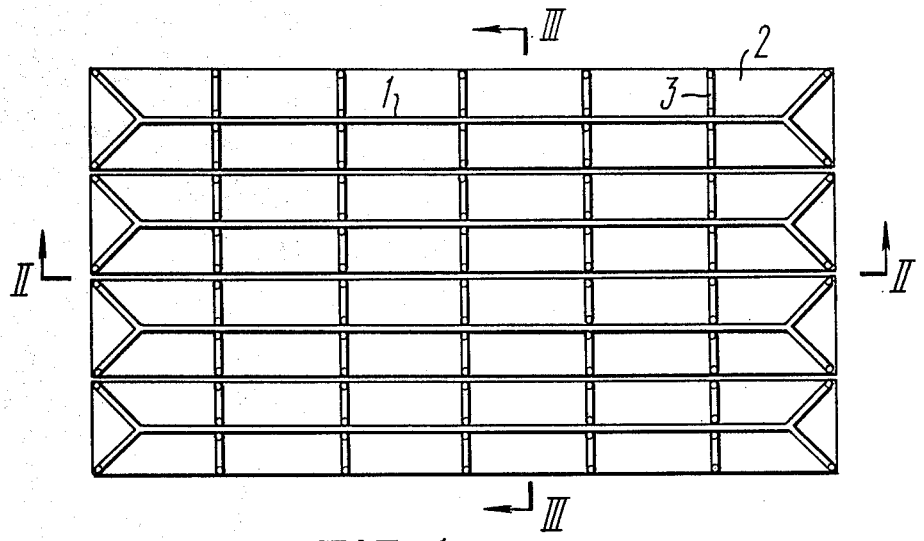
FIG. 1 is a plan view of the roofing structure according to the invention.
Figure 2:
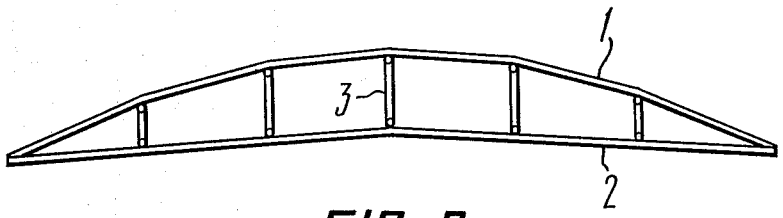
FIG. 2 is a section taken along section line II—II in FIG. 1.
Figure 3:
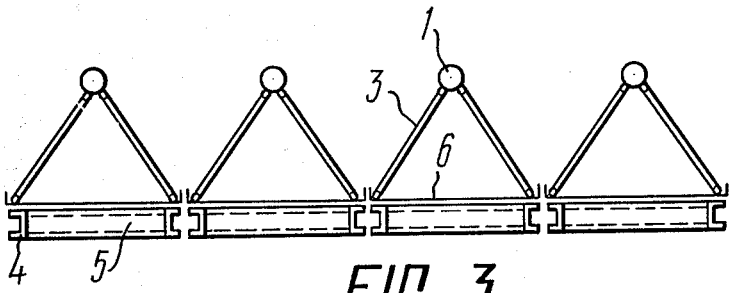
FIG. 3 is a section taken along section line III—III in FIG. 1.

The building roofing (FIGS. 1, 2) according to the invention consists of a number of similar elements in the form of an arch 1 with a tie 2 which are interconnected directly at the ends and by double hangars 3 along the span. The tie 2 of each arch 1 is made as at least one panel consisting of a framework with longitudinal chords 4 (FIG. 3) and cross-pieces 5, and a prestressed sheet covering 6 connected to said framework.

Figure 4:
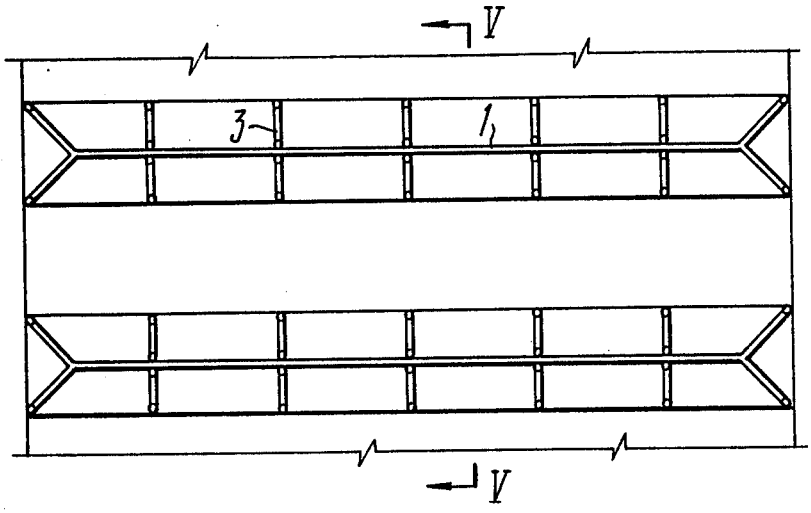
FIG. 4 is another version of the roofing structure, top view.
Figure 5:
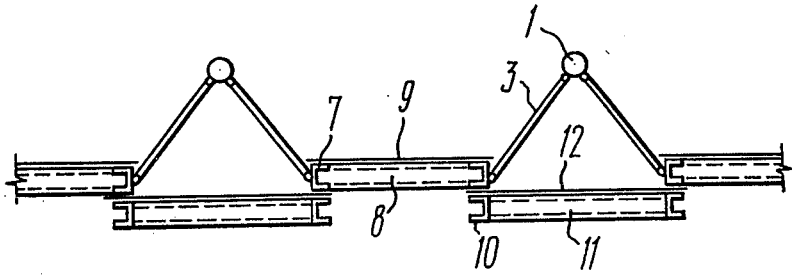
FIG. 5 is a section taken along section line V—V in FIG. 4.
Figure 6:
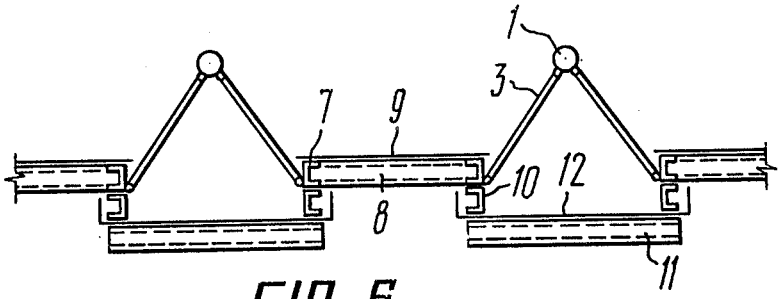
FIG. 6 — same but with the sheet covering of the lower panel located between the longitudinal chords and ties of the framework.

To increase the stiffness of the tie 2 (FIG. 4) the latter is made of an upper panel and a lower panel arranged parallel to each other at different levels; each panel consists of a framework made of longitudinal chords 7 and 10 (FIG. 5), cross-pieces 8 and 11 and sheet coverings 9 and 12 connected to said framework. The upper panel overlaps partly the lower one so that one of the longitudinal chords 7 of the upper panel framework is located above the longitudinal chord 10 of the lower panel framework and connected thereto. For further increase in the stiffness of the tie the sheet covering 12 (FIG. 6) of the lower panel is located between its longitudinal chords 10 and cross-pieces 11. In this case the cross-pieces 11 and longitudinal chords 10 are arranged at different levels for free discharge of precipitation from the roofing along the sheet covering 12 of the lower panel.

Figure 7:
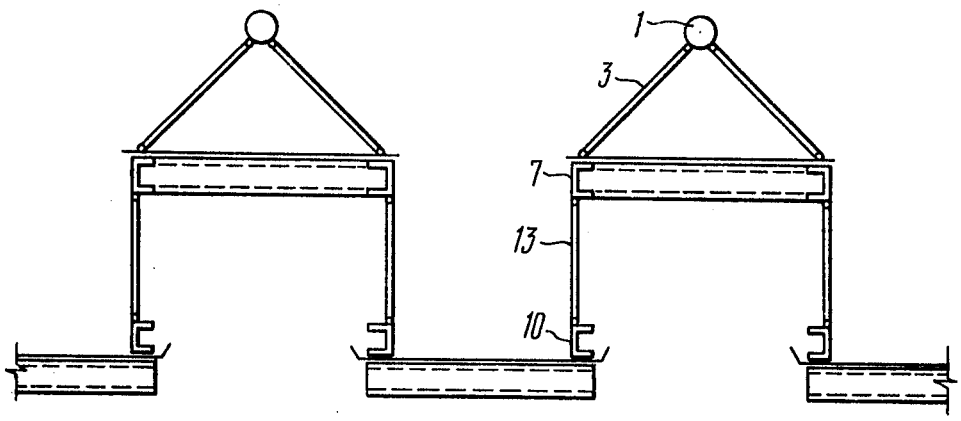
FIG. 7 is a cross section through the roofing structure according to the invention, with vertical skylights.

For providing vertical skylights in a building roofing the longitudinal chord 7 (FIG. 7) of the upper panel and the longitudinal chord 10 of the lower panel are interconnected by the uprights of the skylight frames 13.

Figure 8:
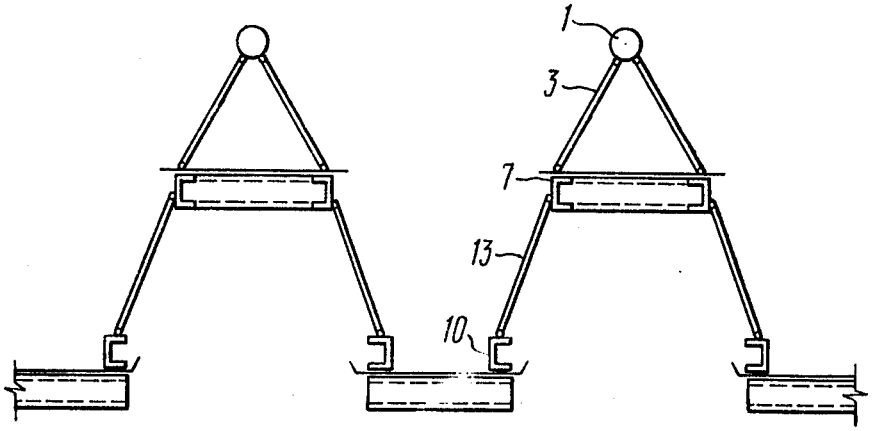
FIG. 8 is a cross section through the roofing structure according to the invention, with inclined skylights.

For making skylights with inclined glass panes the upper and lower panels are arranged in such a manner that the surface of the skylight frame 13 (FIG. 8) connecting the longitudinal chord 7 of the upper panel with the longitudinal chord 10 of the lower panel forms the required angle to the line of horizon.

Let us consider the work of the building roofing according to the invention under the effect of various loads.

When the roofing takes a load applied to the tie 2 (FIGS. 1, 2) in any point or distributed uniformly along its length and directed from the top down, there arise compressive forces in the arch 1 and tensile forces in the tie 2 and hangars 3. In the known structure of the hangar roof in Milan the roofing elements acting as a protection cannot take part in the load-bearing function of the tie and thus are a superfluous structure which increases unduly the weight of the roofing.

In the structure according to the invention the material of the sheet covering is used simultaneously as a protective and load-bearing element. Besides, the tie made in the form of panels with thinsheet covering makes it possible to reduce the number of elements included into the roofing structure. Both these factors, i.e. the combination of the load-bearing and protective functions in the covering and the design of the tie in the form of panels reduce both the weight of the roofing and the amount of labour required for its erection.

Prestressing of the sheet coverings of the panels allows the latter to take part in the load-bearing function of the tie under compressive forces arising when the roofing is acted upon by the upward-directed force.

We have found that the tie consisting of an upper panel and a lower panel arranged at different levels and overlapping each other partly so that one of the longitudinal chords of the upper panel is located above the longitudinal chord of the lower panel and connected therewith it can be used as an independent element of the roofing.

It can be seen from the description that the building roofing structure according to the invention wherein the roofing protective elements take part in the load-bearing function ensures the most rational utilization of the roofing material. As compared with other known solutions of the similar type the structure according to the invention affords a considerable saving in the material required for its manufacture. The manufacture of the ties in the form of panels used as prefabricated elements of the roofing makes it possible to exclude many difficult operations related to erection of the roofing which have to be performed in the known structures of this type, e.g. high-altitude work for installation of trusses, girders and roofing elements placed on them, the work involved in stopping numerous joints, in waterproofing, etc. The roofing according to the invention is erected by installation of large prefabricated elements so that high-altitude work is confined only to installation of the ready roofing elements consisting of an arch and a tie, assembled and interconnected on the ground, and to stopping of the longitudinal joints between the above-mentioned prefabricated parts.

Thus, the amount of labour involved in erecting the roofing of the structure according to the invention is considerably smaller than that required in the above-mentioned and other structres of this type.

What is claimed is:

1. A building roofing structure comprising a plurality of alike structural units disposed extending generally longitudinally in parallel relationship; each unit comprising a plurality of members connected to define an arch, a plurality of paired hangers connected to the arch disposed paired along the span of the arch substantially normal thereto in plan, each pair of hangars defining similar and equal sides of a triangular configuration in cross section with the arch defining the apex, each end of the arch being bifurcated and defining a pair of hangars at an angle relative to the longitudinal direction of the arch and each defining a continuation of the arch, laterally spaced parallel ties remote from the arch connected to respective ones of the paired hangers at ends thereof opposite to the ends thereof connected to said arch, each of the ties of each unit comprising a plurality of longitudinal chords, a plurality of crosspieces connecting the ties transversely of each of the corresponding units at points where the paired hangers are connected to respective ones of the two parallel ties of a unit; and each unit having prestressed sheet material overlying the space between the parallel ties and crosspieces therein and secured to the ties to thereby participate in the load-bearing of each unit.

2. A building roofing structure according to claim 1, in which said crosspieces are at the level of said ties, said sheet material being disposed overlying said crosspieces and connected thereto.

3. A building roofing structure according to claim 2, in which some of said structural units are laterally spaced, a plurality of paired opposed upstanding frame members connected to the parallel ties of a corresponding unit for supporting it, parallel ties for each of the structural units connected to and supporting the upstanding frame members and disposed longitudinally in corresponding planes with the ties of the corresponding structural unit, and a plurality of crosspieces constructed similarly to said chords in cross section connecting the laterally spaced lowermost support ties of next adjacent structural units, whereby the laterally spaced structural units define structures for skylights.

4. A building roofing structure according to claim 1, in which said additional ties underlie the first-mentioned ties of each structural unit and are connected thereto parallel therewith, said crosspieces being disposed directly connecting the additional ties, said structural units being laterally disposed, connecting crosspieces connecting the ties of next adjacent structural units and disposed parallel to the first-mentioned crosspieces, and prestressed sheet material overlying the connecting crosspieces and connected thereto.

* * * * *